US008087634B2

(12) United States Patent
Taylor

(10) Patent No.: US 8,087,634 B2
(45) Date of Patent: Jan. 3, 2012

(54) ONE HANDED ICE CUBE TRAY

(76) Inventor: Gilbert Robert Taylor, Niagara Falls (CA)

( * ) Notice: Subject to any disclaimer, the term of this patent is extended or adjusted under 35 U.S.C. 154(b) by 0 days.

(21) Appl. No.: 12/656,653

(22) Filed: Feb. 12, 2010

(65) Prior Publication Data

US 2011/0200703 A1 Aug. 18, 2011

(51) Int. Cl.
*B28B 7/06* (2006.01)
*F25C 1/06* (2006.01)

(52) U.S. Cl. ..... 249/127; 249/69; 249/119; 249/120; 249/134; D15/90

(58) Field of Classification Search ..... 249/60, 249/69, 70, 76, 117, 119, 120, 127, 134, 249/139; D15/90
See application file for complete search history.

(56) References Cited

U.S. PATENT DOCUMENTS 3,390,543 A * 7/1968 Moreland, II et al. ..... 62/353
4,142,377 A * 3/1979 Fogt ..... 62/135
4,417,716 A * 11/1983 Penna et al. ..... 249/121
4,432,529 A * 2/1984 McMillan ..... 249/52
6,168,131 B1 * 1/2001 Tabatabaie ..... 249/121
2004/0182989 A1 * 9/2004 De Buyer ..... 249/127
2004/0249059 A1 * 12/2004 Akbar et al. ..... 524/588
2005/0160757 A1 * 7/2005 Choi et al. ..... 62/344
2009/0308880 A1 * 12/2009 Sims et al. ..... 220/649

OTHER PUBLICATIONS

Kitchen countertops, published by Tradercity.com, posted on Dec. 4, 2009, pp. 1-6.*
Direct Kitchen remodeling, published by direct buy.com, pp. 1-3 (date not applicable).*
Granite countertops, published on Jun. 16, 2009, pp. 1-10.*

* cited by examiner

*Primary Examiner* — Joseph Del Sole
*Assistant Examiner* — Dimple Bodawala

(57) ABSTRACT

The one handed ice cube tray is an ice cube tray with a large opening that works like a hand that holds the front edge of a kitchen counter top to secure that end of the ice cube tray to allow one hand to twist or flex the ice cube tray and hold it flexed to ensure the ice cubes remain elevated to allow the other free hand to take out the desired amount of ice cubes.

1 Claim, 1 Drawing Sheet

ONE HANDED ICE CUBE TRAY

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF INVENTION

Flexible plastic ice cube trays are common place around the world today. The main drawbacks with most of these flexible ice cube trays is that when you flex these ice cube trays using two hands, the ice cubes rise upwards enough to retrieve, but soon as you stop flexing the ice cube tray to retrieve the ice cubes the ice cubes recede back down into their individual compartments, thus making it difficult to remove desired amount of ice cubes. The ice cube tray may be inverted to remove the ice cubes into a container often spilling some of the ice cubes on the counter top or on the floor.

BRIEF SUMMARY OF THE INVENTION

My invention relates to flexible ice cube trays particularly a way to flex the ice cube tray with the use of one hand so that there is a free hand to retrieve the desired amount of ice cubes. A large opening on one end of the ice cube tray that preferably has a front edge of a standard size kitchen counter top fit into it to secure that end of the ice cube tray when twisting the one handed ice cube tray.

DETAILED DESCRIPTION

Figure 1:
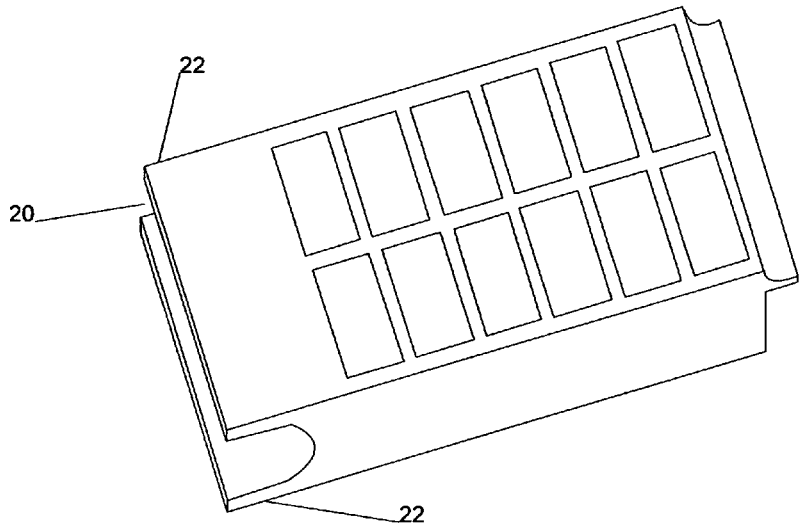
FIG. 1 is a perspective view of an ice cube tray with an aperture on one end of the ice cube tray in accordance with the invention.
Figure 2:
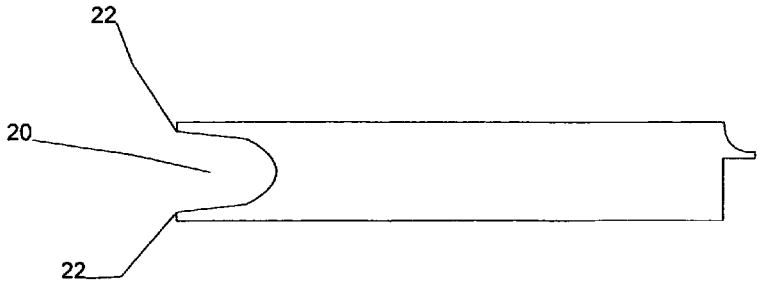
FIG. 2 is a side view of the aperture end of the ice cube tray in accordance with the invention.

Referring to the drawings in detail the one handed ice cube trays objectives are accomplished in accordance with the present invention by having large aperture 20 on one end of said tray; the length of the aperture 20 is preferred to be the same size as said tray is wide; the height of the aperture 20 is preferred to be large enough to receive the front edge of a standard size kitchen counter top; the aperture 20 depth is preferred to be deep enough to secure said tray to said counter top when flexing the one handed ice cube tray left or right; it is preferred that the thickness of the sleeves 22 that circum the said counter top are to be smaller at the front and gradually thicker towards the back thus allowing the front of the aperture 20 to be forced open to receive larger counter tops into it; the back of the aperture 20 is preferred to be half round or half cylindrical shape throughout the length of the aperture 20; thus adding strength to the sleeves 22 when flexed.

The one handed ice cube tray is to receive a secured standard size kitchen counter top to fit between the aperture 20 end on said tray; the sleeves 22 are strong and flexible enough to be twisted up or down to hold said end secure to the counter top to allow the ice cube tray to be flexed or twisted with the use of one hand, thus allowing one hand to be free to remove the desired amount ice cubes The one handed ice cube tray is preferred to be molded into one piece from one of the flexible plastics commonly used.

The invention claimed is:

1. A one-handed flexible ice cube tray comprising a large aperture on one end surface of said tray; and a sleeve surrounding said large aperture, wherein height of said large aperture is approximately 1.5 inches, wherein said aperture end surface of said tray configured to fit a front edge of a standard size kitchen counter top, and to allow said tray to be flexed or twisted with use of one hand for removing desired amount ice cubes from said tray.

* * * * *